US005312313A

United States Patent [19]

Holmes et al.

[11] Patent Number: 5,312,313

[45] Date of Patent: May 17, 1994

[54] DEVICE TO PREVENT BINDING OF A GUIDANCE SYSTEM FOR AN UPPER BODY EXERCISE APPARATUS

[75] Inventors: Fred H. Holmes, Gore, Okla.; Robert L. Rawls, Woodinville; James A. Duncan, Renton, both of Wash.

[73] Assignee: Stairmaster Sports Medical Products, Inc., Kirkland, Wash.

[21] Appl. No.: 860,722

[22] Filed: Mar. 31, 1992

Related U.S. Application Data

[63] Continuation-in-part of Ser. No. 685,364, Apr. 15, 1991.

[51] Int. Cl.[5] ..... A63B 21/00

[52] U.S. Cl. ..... 482/95; 482/51

[58] Field of Search ..... 482/41, 51, 52, 53, 482/38, 101, 95, 92, 93, 94, 96, 113

[56] References Cited

U.S. PATENT DOCUMENTS

| | | | |
|---|---|---|---|
| 1,521,487 | 12/1924 | Turner . | |
| 1,854,473 | 4/1932 | Laborda, Jr. . | |
| 3,381,958 | 5/1968 | Gulland . | |
| 3,394,934 | 7/1968 | Elia et al. . | |
| 3,495,824 | 2/1970 | Cuinier . | |
| 3,497,215 | 2/1970 | Harrison . | |
| 3,582,069 | 6/1971 | Flick . | |
| 3,587,319 | 6/1971 | Andrews . | |
| 3,592,466 | 7/1971 | Parsons . | |
| 3,628,791 | 12/1971 | Garcia . | |
| 3,704,886 | 12/1972 | Kay et al. . | |
| 3,707,285 | 12/1972 | Martin | 482/38 |
| 3,746,338 | 7/1973 | Proctor | 482/101 |
| 3,747,924 | 7/1973 | Champoux . | |
| 3,756,595 | 9/1973 | Hague . | |
| 3,758,112 | 9/1973 | Crum et al. . | |
| 3,759,511 | 9/1973 | Zinkin et al. . | |
| 3,765,245 | 10/1973 | Hampl . | |
| 3,824,994 | 7/1974 | Soderberg, Sr. . | |
| 4,082,267 | 4/1978 | Flavell . | |
| 4,112,928 | 9/1978 | Putsch . | |
| 4,199,139 | 4/1980 | Mahnke . | |
| 4,220,996 | 9/1980 | Searcy . | |
| 4,298,893 | 11/1981 | Holmes . | |
| 4,416,293 | 11/1983 | Anderson . | |
| 4,468,025 | 8/1984 | Sferle . | |
| 4,496,147 | 1/1985 | De Cloux et al. . | |
| 4,512,566 | 4/1985 | Bicocchi . | |
| 4,519,603 | 5/1985 | De Cloux et al. . | |
| 4,555,108 | 11/1985 | Monteiro . | |
| 4,720,093 | 1/1988 | Del Mar . | |
| 4,846,458 | 7/1989 | Potts | 482/41 |
| 5,011,139 | 4/1991 | Towley | 482/41 |

*Primary Examiner*—Stephen R. Crow
*Attorney, Agent, or Firm*—Seed and Berry

[57] ABSTRACT

An upper body exercise apparatus to assist an exerciser to do chin-ups and dips. The apparatus includes a frame having a base, a support for the exerciser, and chin-up handles and dip handles extending from the frame. A motive device provides for movement of the support vertically between a lower position and an upper position. Angular displacement of the platform is prevented by coupling the platform to a guide device which constrains the support to travel along a predetermined path. The guide device can comprise a wheel and track system. Binding of the wheel and track system is avoided by providing a force to the wheel and track system which tends enhance tracking.

22 Claims, 13 Drawing Sheets

DEVICE TO PREVENT BINDING OF A GUIDANCE SYSTEM FOR AN UPPER BODY EXERCISE APPARATUS

The application is a continuation-in-part of U.S. application Ser. No. 07/685,364, filed Apr. 15, 1991. Reference is made to Ser. No. 07/689,670, filed Apr. 4, 1991, which is a continuation of Ser. No. 07/441,011, filed Jul. 11, 1989, now abandoned.

BACKGROUND OF THE INVENTION

The present invention relates to an improved exercise device for the upper body muscles that provides an upward, vertical force to assist the exerciser with chin-ups and dips. Chin-up or dip exercises require strong upper body muscles. In most exercisers these upper body muscles are not sufficiently developed and the exercises can only be performed with great difficulty if at all.

Typical upper body exercise apparatuses either provide no assistance to the exerciser or are cumbersome to use and operate. For example, the device described in the patent to Roberts, U.S. Pat. No. 4,111,414, requires the user to step into a harness while manually adjusting weights. Other devices provide a platform on which the exerciser stands, but the force applied to assist the exerciser either causes arcuate motion of the platform, or provides a non-linear assist force.

In particular, McFee in U.S. Pat. No. 4,470,587, illustrates an oscillating platform articulated to a parallelogram assembly having fixed pivot points. Thus, as the platform moves from an initial position to an upper position, the platform must necessarily traverse an arc. The arcuate motion of the platform causes the user's feet to traverse an arc while the user's hands grip the chin-up or dip handles and a true chin-up or dip exercise cannot be performed.

The Martin device, U.S. Pat. No. 4,452,447, contains an oscillating platform attached to elastic spring members which provide an upward force to assist the user. The elastic members behave in a similar fashion to springs and the amount of assistance force therefore varies with the displacement of the platform.

One device described in Potts U.S. Pat. No. 4,846,458, does disclose an oscillating platform with essentially uniform upward force and free of arcuate motion. The Potts device uses a system of levers and hydraulic lifts to move the platform. As the platform moves up and down, a short arm causes the effective length of the moment arm to change. The change in moment arm compensates for the non-linearity of the pneumatic lifters and provides a substantially linear assist force to the platform. An accumulator and air compressor motor are used to control the volume of fluid in the pneumatic cylinder and thus the amount of assist provided to the user.

SUMMARY OF THE INVENTION

According to one embodiment, the present invention contains an oscillating platform which provides a vertical force to assist the user in performing true chin-up and dip exercises. The platform is connected to a guidance system such as a wheel and track system which guides the platform along a predetermined path. The wheel and track system prevents substantial deviation from the predetermined path. Preferably, the predetermined path is linear. Preferably, the predetermined path is vertical to avoid horizontal displacement of the platform. In order to provide for smooth, binding-free operation of the wheel and track system, a torque caused by the weight of the user is used to maintain the wheels in contact with the tracks and properly tracking along the tracks. The motive force may be provided to the platform in numerous ways. Devices for providing the force to the platform can include a weight stack.

The use of a track and wheel system to guide the platform eliminates the need for a system of complex moments and levers.

The device of the present invention thus provides the user with a more convenient, more reliable, less costly means for doing assisted dip and chin-up exercises. The configuration of the track and wheel guidance system and associated forces reduces or eliminates binding, without incurring the costs associated with a close-tolerance device. The exercise apparatus of the present invention permits users of various abilities to preform the upper body exercises in proper form preferably providing a variable (e.g., usersettable), but substantially flat (i.e., constant throughout a stroke) assist force to the platform without inducing platform arcuate motion. The exercise device of the present invention thus enables persons of all fitness levels to perform proper dip and chin-up exercises. The reduced complexity of the device also means that the exercise benefits of the device can be had at a reduced cost.

DESCRIPTION OF THE SPECIFIC EMBODIMENT

Figure 1:
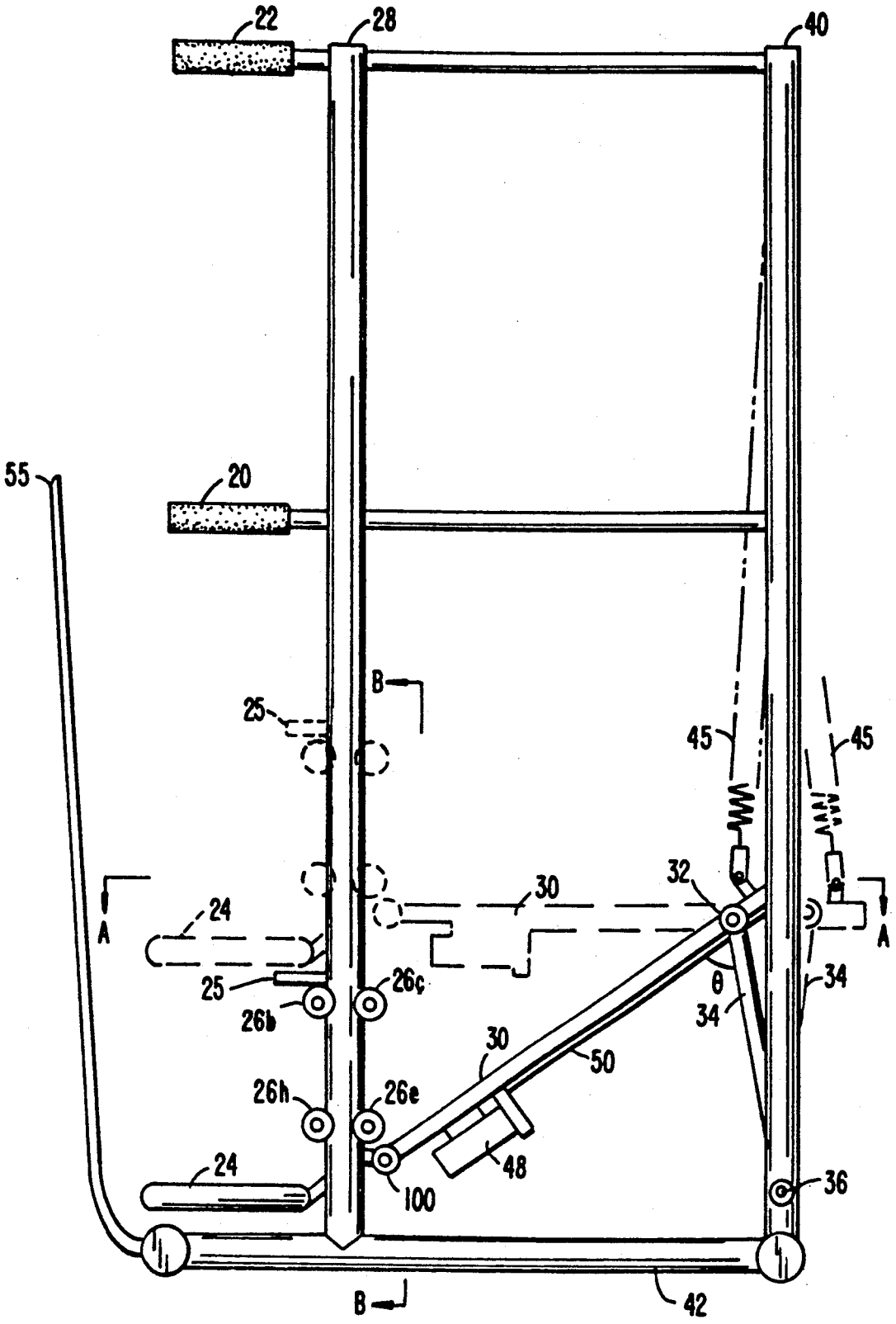
FIG. 1 is a side view of an upper body exercise apparatus according to an embodiment of the present invention.

FIG. 1 shows a side view of an exercise apparatus on which chin-ups and dips can be performed. A chin-up exercise is an exercise in which an exerciser grasps a handle which is at least higher than shoulder level, preferably higher than head level, and pulls on the handle to at least partially lift himself or herself using, primarily, the upper body muscles. In a dip exercise, the exerciser grasps one or more handles below shoulder level, preferably approximately waist level and lowers and then raises himself or herself, supporting at least part of his or her body weight during the lowering and raising on the handles, using primarily the upper body muscles. To perform a dip exercise, the exerciser begins with the arms extended downward, and hands gripping handles 20. Handles 20 and 22 are covered by a grip to prevent slipping. The exerciser lowers the body by bending at the elbows and then straightens the elbows to lift the body back to the starting position. To perform a chin-up, the exerciser grabs handle 22 located above his/her head and pulls the body upward. In both exercises, the exerciser must overcome the force of gravity. Repetitions of the exercises develop strength and stamina and also promote physical fitness.

Not every exerciser has developed the muscle strength necessary to counteract their own weight and perform chin-up and dip exercises unassisted, or to perform repetitions of the exercise. The exercise device of the present invention therefore includes mechanisms which can provide a vertical force opposite the force of gravity to counteract the exerciser's weight and assist in performance of the exercises.

Figure 12:
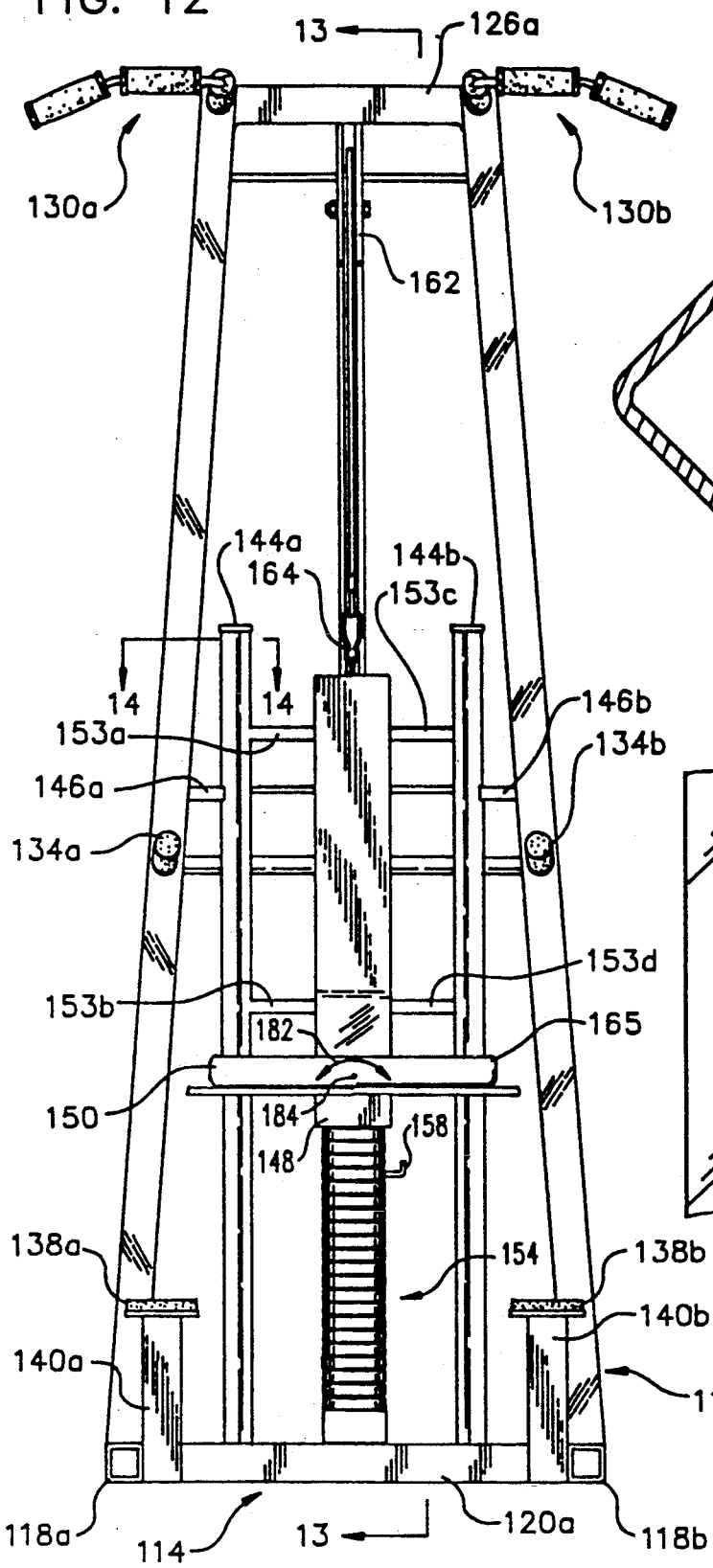
FIG. 12 is a front-elevational view, partially broken-away, of an exercise apparatus according to one embodiment of the present invention.
Figure 14:
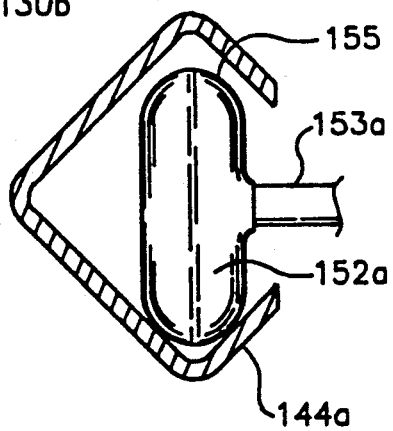
FIG. 14 is a cross-sectional view taken along line 14—14 of FIG. 12.

FIG. 12 depicts an exercise apparatus according to one embodiment of the invention. The apparatus includes a frame 112 which is made up of a base 114 and a box-like upper structure 116. The frame 112 can be made from a number of materials including steel, wood, epoxy composites, ceramic or ceramic composites, fiberglass, plastics and the like. In one embodiment, the frame 112 is made from square-cross section hollow steel beams. The base 114 includes left and right base beams 118*a*, 118*b* attached to fore and aft beams 120*a*, 120*b* such as by welding, bolting, screwing and the like.

The upper structure includes left and right aft upright beams 122*a*, left and right forward inclined beams 124*a*, 124*b*. Forward and aft upper cross beams 126*a*, 126*b* and left and right upper beams 128*a*, 128*b*. A pair of upper handles 130*a*, 130*b* extend from the upper structure, preferably from an extension of the upper left and right beams 128*a*, 128*b*. The apparatus has a height 132 of about 81 inches (about two meters). A pair of lower handles 134*a*, 134*b* extend from the frame at a height of about three feet (about one meter) 136. Left and right steps 138*a*, 138*b* are attached to the left and right base beams 118*a*, 118*b* by uprights 140*a*,140*b* for a purpose to be described below. In the embodiment depicted in FIGS. 12–16 the handles 130*a*, 130*b*, 134*a*, 134*b* are coupled to the frame 112, such as by being welded, bolted, pinned or screwed in a fixed position with respect to the frame.

An exerciser support structure 142 is coupled to the frame 112. The exerciser support structure 142 includes an exerciser lift portion 146 and a guidance structure 147. The exerciser lift portion 146 includes an L-shaped arm 148 and a kneeling pad 150. The track and wheel guidance system is spaced horizontally 145 about one and one-half feet (about half a meter) from the center of the exerciser lift portion 146. The guidance structure 147 includes left and right tracks 144*a*, 144*b* and followers such as first, second, third and fourth wheels 152*a*, 152*b*, 152*c*, 152*d* constrained to travel along the tracks 144*a*, 144*b* as described more fully below. The arm 148 is connected to the wheels 152 by axles 153*a*, 153*b*, 153*c*, 153*d*. The tracks 144*a*, 144*b* are coupled to the frame such as by attachment using arms 146*a*, 146*b* and by welding to the base 114. A force source such as a weight stack 154 is coupled to the exerciser support 142 via a line 156. The line 156 can be a cable, a chain, a belt, a rope, or other similar structures. The weight stack 154 includes a plurality of weights which can be selectively coupled to the line 156 using a key 158 in a manner well-known in the art. The weights which are coupled to the line will, during lifting (as described below) be guided along bars 160*a*, 160*b*. The line 156 travels over a line guidance mechanism such as a pulley 162 attached to the frame 112 and is attached to the exerciser support 142 such as by inter-linking eyelets 164.

The apparatus depicted in FIGS. 12–16 is freestanding in the sense that it is not necessary that the device be attached to a wall. The device, for example, may be positioned in the center of the room and may be readily moved from one location to another. By eliminating a need for connection to a wall, there is great flexibility in the positioning of the apparatus which is useful in the context of either home use where space for exercise equipment is often limited, or use in an exercise or health club where space is often at a premium because of the need to accommodate many types of exercise equipment.

The exerciser lift portion 146 of the exerciser support 142 is movable along a linear path defining an axis 192. In the depicted embodiment, the exerciser lift portion 146 is movable along a vertical path, defined by the tracks 144*a*, 144*b* from an uppermost position 165 defining a first height 166 to a lowermost position 168 defining a second height 170. The range of motion of the support between the uppermost position 165 and the lowermost position 168 and the heights of the handles 132, 136 are selected such that the apparatus can be used by exercisers having a wide range of heights without the need for providing adjustability of the handles 130*a*, 130*b*, 134*a*, 134*b* (although the handles may be made adjustable, nevertheless, if such is desired). In the depicted embodiment, persons having heights ranging from about 6 feet 10 inches to about 4 feet 10 inches can normally perform chin exercises using the upper handles 130*a*, 130*b*. Persons having heights in the range of seven feet six inches to about 2 feet can typically perform dip exercises using the handles 134a, 134*b*. Regarding chin exercises, shorter persons will be able to perform chin exercises by using the exerciser lift portion 146 in the upper portion 174 of the range 172 while taller persons will perform chin exercises with the exerciser lift portion 146 in the lower portion 176 of the range 172. In this way, the apparatus can accommodate the range of height of exercisers without the necessity for adjusting the handles.

In order to avoid a high construction and materials cost, the wheel 152*a* and channel 144*a* are not necessarily close-tolerance devices (which are expensive to produce, design and maintain) and thus there is typically an amount of clearance 155 (exaggerated) between the wheel 152*a* and channel 144*a*. In the absence of corrective measures, a higher clearance 155 contributes to a potential for jamming chattering, noise, etc.

Figure 17:
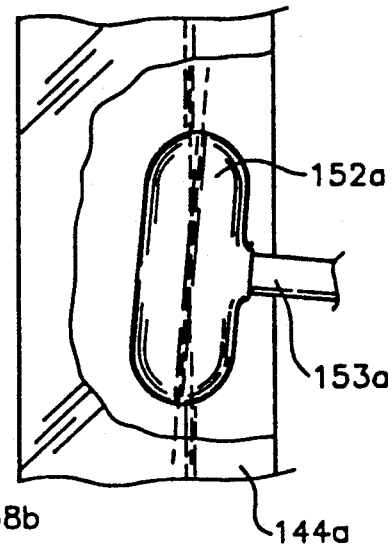
FIG. 17 is a partial front-elevational view of a track, partially broken-away to show a wheel therein.

These undesirable effects can be exacerbated if the weight of the exerciser is not evenly distributed left-to-right. Such uneven left-to-right weight distribution creates a torque 182 about the fore-aft axis 184 of the support 142. This type of torque 182 can cause the wheels 152 to "climb" the channels as depicted (in exaggerated fashion) in FIG. 17 further contributing to jamming.

Because the exerciser lift portion 146 such as the kneeling pad 150, is cantilevered from the guidance portion 147, the downward force 178 from the weight of an exerciser creates a net torquing force 180 on the exerciser support 142.

Figure 13:
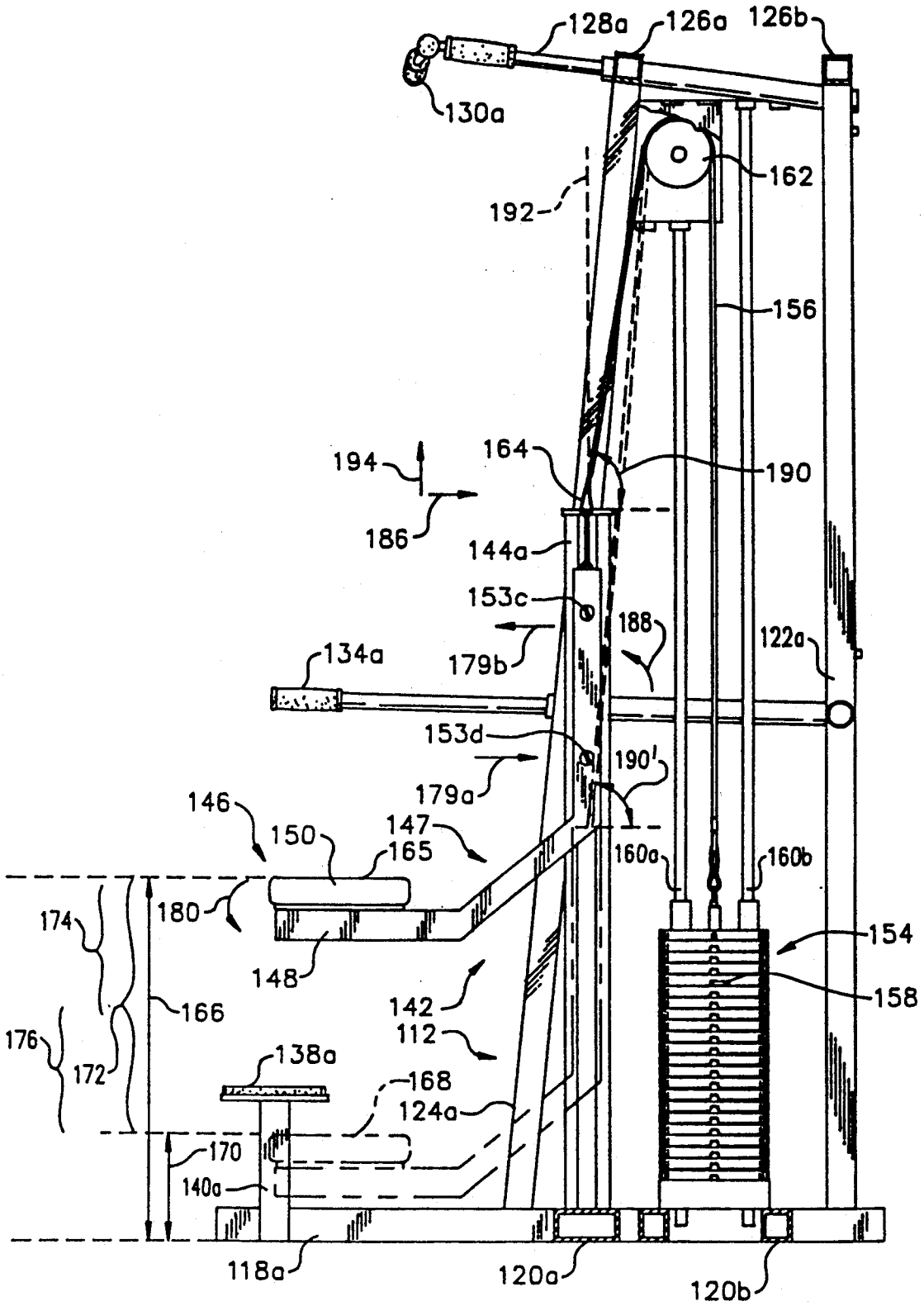
FIG. 13 is a cross-sectional view taken along line 13—13 of FIG. 12.
Figure 15:
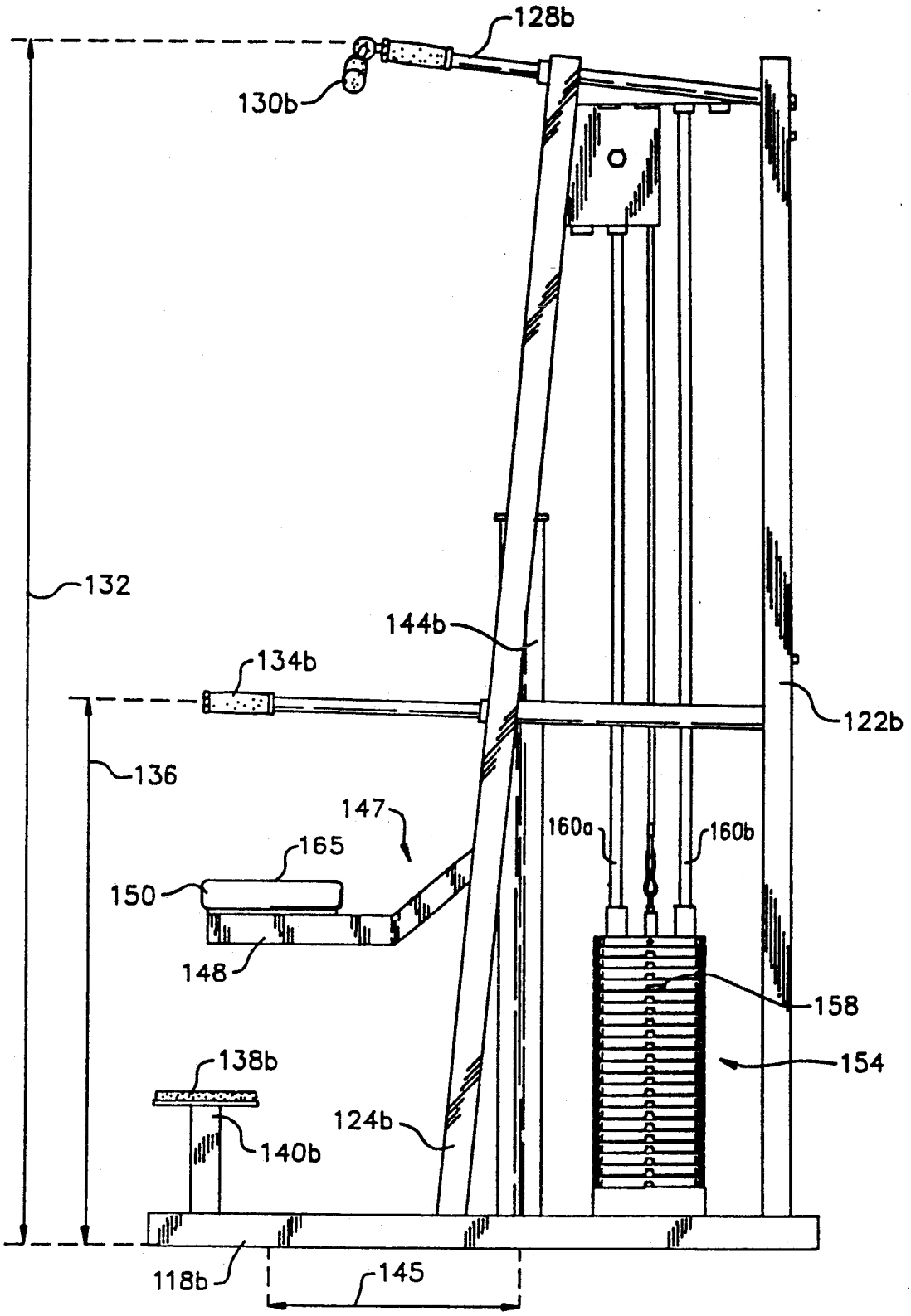
FIG. 15 is a side-elevational view of the apparatus of FIG. 12.
Figure 16:
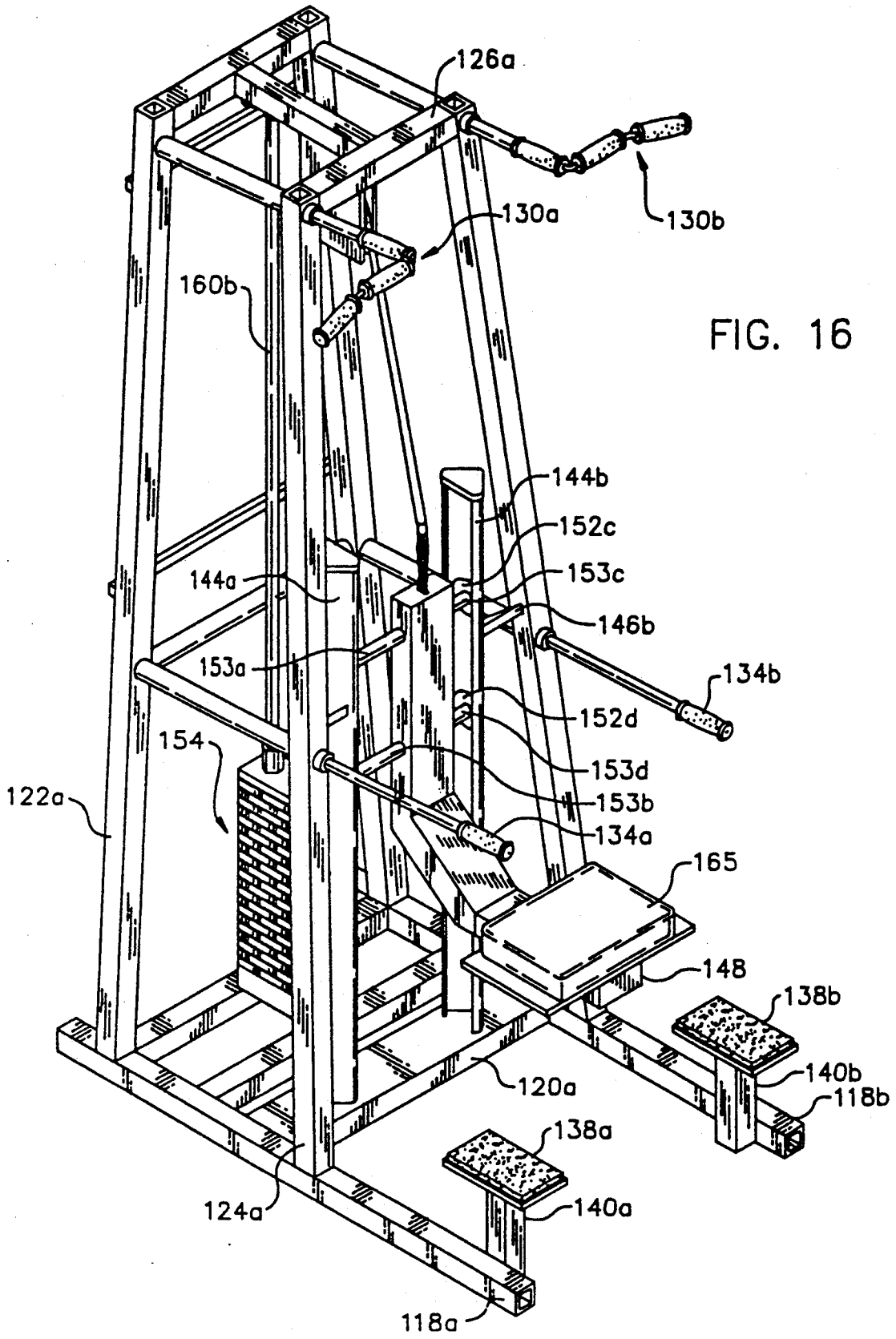
FIG. 16 is a perspective view of the apparatus of FIG. 12.

As noted, each of the left guidance system 143*a* and right guidance system 143*b* includes two followers, such as wheels 152*a*, 152*b* which are spaced apart in the direction of travel. This spaced-apart arrangement is used, in one embodiment, to achieve loading of the system that contributes to proper tracking. In particular, the torquing force 180 causes the lower wheels 152*b*, 152*d* to push 179*a* against the aft portion of the channels 144*a*, 144*b* and the upper wheels 152*a*, 152*c* to push 179*b* against the forward portion of the channels 144*a*, 144*b*, e.g., as depicted in FIG. 13. Such forcing of the wheels against the channels imparts a self-aligning property to the track-and-wheel assembly, making the system tolerant of minor misalignment or off-center weight distribution.

The present invention provides for reduction or elimination of jamming without needing to incur the costs of a close-tolerance system. The present invention includes using the cantilevered weight of the exerciser to provide the torque 180. In the depicted embodiment, the lifting force is provided by coupling the line 156 to the exerciser support 142. In the depicted embodiment, the line 156 is coupled at an angle 190 to the direction of motion 192 of the exerciser support 142. Thus, the lifting force has a vertical component 194 and a horizontal component 186. This tends to cause a torque in a direction 188 opposite to the direction of the first torque 180, thus, at least partially counteracting the first torque 180. The force 186 must not be so large as to prevent the desired degree of torque 180.

The angle of the line 156 will vary between a smaller angle 190 when the support 142 is in the upper position 165 and a larger angle 190' when the support is in the lowermost position 168. These angles 190, 190' are sufficiently small that the magnitude of the force 186 is insufficient to substantially counteract the first torque 180 for an average-weight exerciser in a typical exercising position so as to interfere with the desired loading of the track and wheel system and contribute to jamming. Preferably, the angles 190, 190' are greater than about 45°, more preferably about 70°, most preferably 80° or more. The line 156 provides both a rearward-directed component of force and an upward-directed component of force 194.

In operation, the exerciser selects a weight using the key 158. A smaller selected weight will provide less assistance to the exerciser and require more exerciser effort. The exerciser grasps the lower handles 134*a*, 134*b* and steps onto one of the steps 138*a*, 138*b*. The exerciser then uses a knee to lower the kneeling pad 150 and, shifting weight to the handles 134*a*, 134*b* brings the other knee onto the kneeling pad 150. The exerciser is now in a position to perform dip exercises as described above. The upward component 194 of the force provided by the weight stack 154 via the line 156 provides assist to the exerciser in performing the dip exercises by offsetting some of the downward force due to gravity.

In order to perform chin exercises, the user extends his arms to raise the platform 148 to a position in the upper range 174, thus positioning the exerciser in a location where he or she may grasp the upper handles 130*a*, 130*b*. The exerciser may now perform chin exercises as described above.

Figure 2:
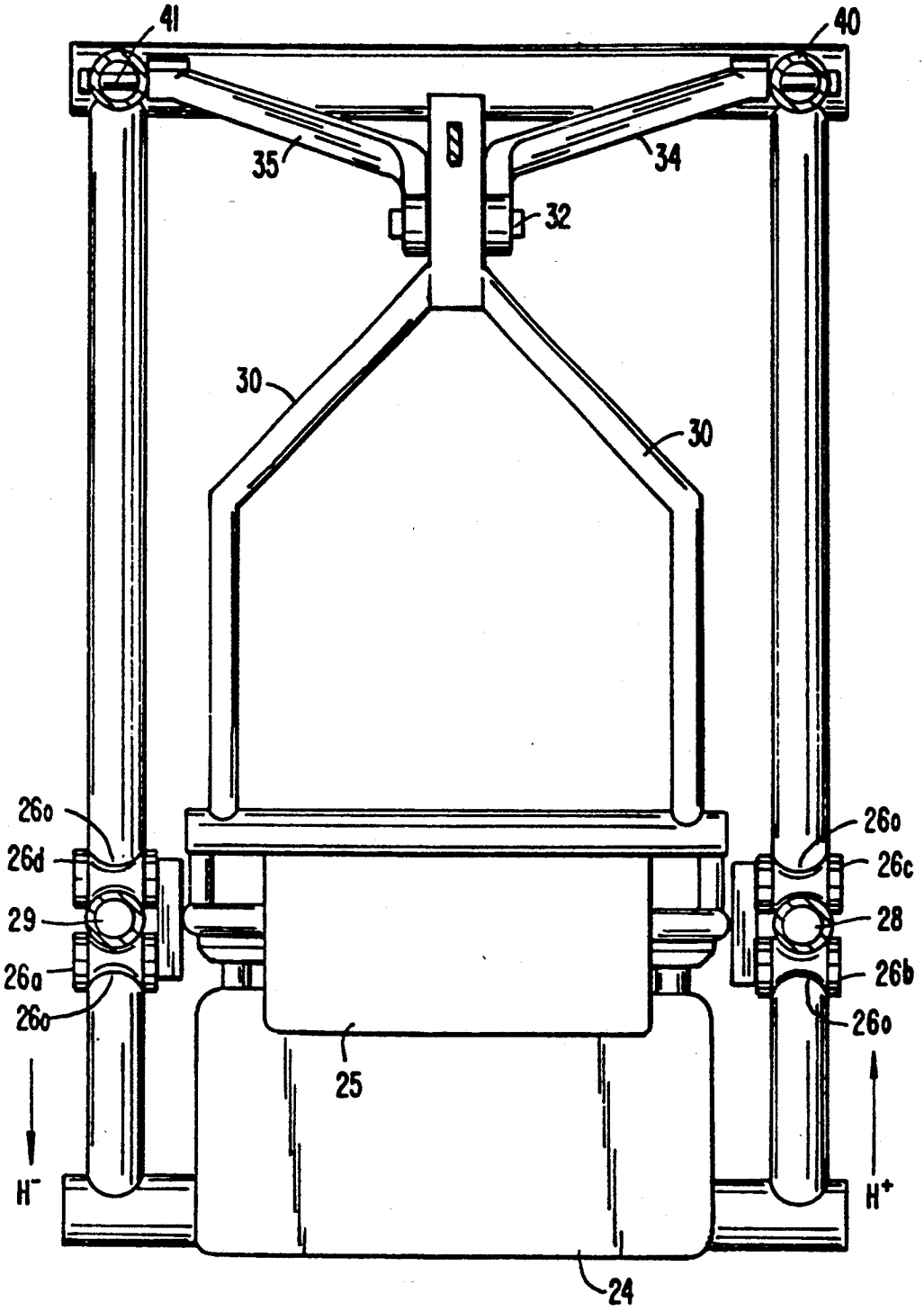
FIG. 2 shows section A—A of the drawing of an upper body exercise apparatus as shown in FIG. 1.
Figure 3:
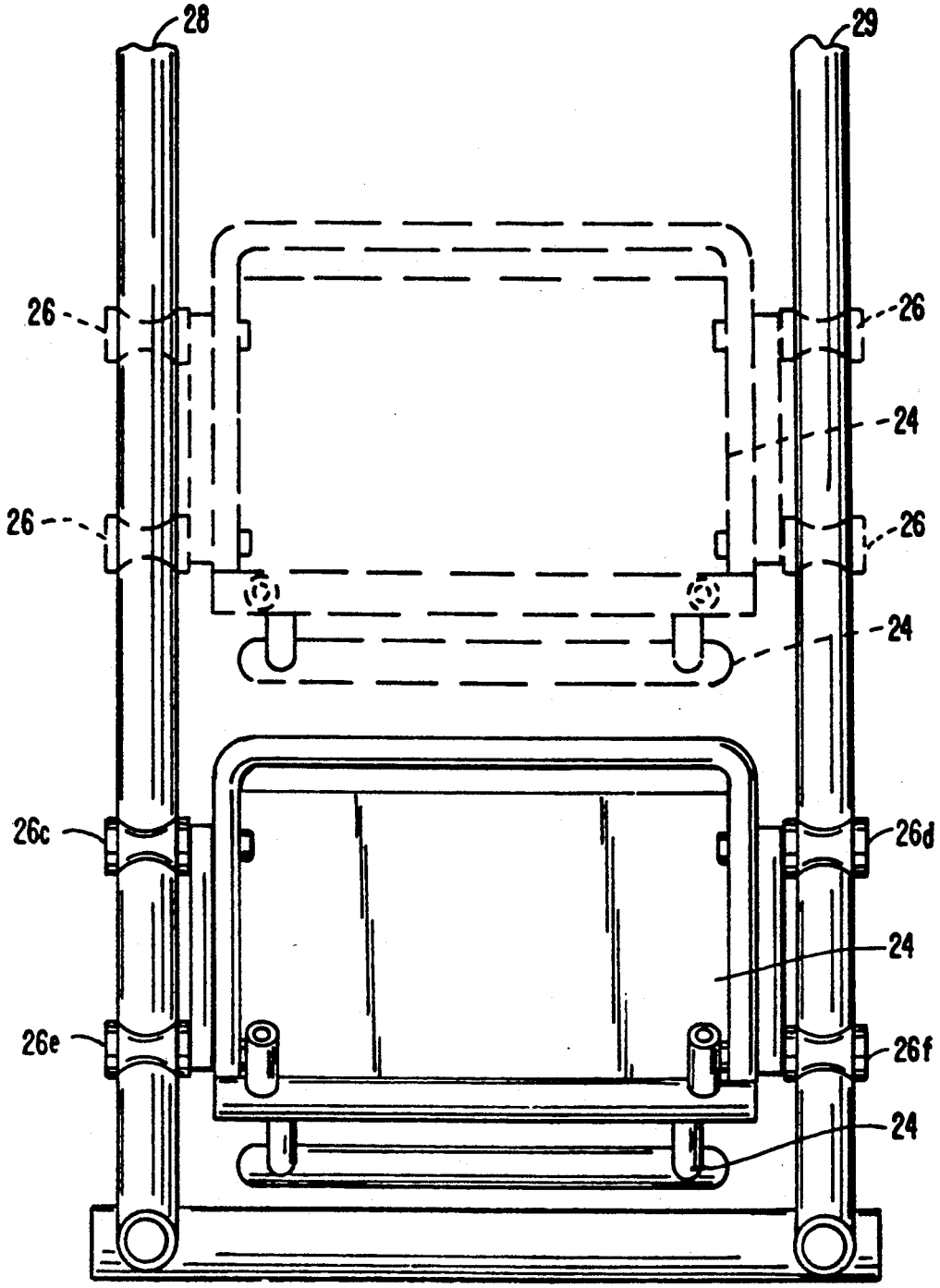
FIG. 3 shows section B—B of the drawing of an upper body exercise apparatus as shown in FIG. 1.

An apparatus, as depicted in FIGS. 1–11, will now be described. The device depicted in FIGS. 1–11 includes an L-shaped platform 24 on which the exerciser may mount the apparatus. A step 25 is provided on the vertical portion of L-shaped platform 24 to assist users in reaching the upper set of handles 22. The vertical portion of L-shaped platform 24 also contains a set of four rollers 26 which are located around each side of vertical frame posts 28 and 29. FIG. 2 shows section A—A of Fig. 1 which illustrates this arrangement more clearly. Alternately, the top set of rollers 26 may be omitted to curb production costs in this embodiment of the invention. Rollers 26 allow platform 24 to travel vertically along frame posts 28 and 29 and prevent the platform from travelling horizontally thereby ensuring that platform 24 has no arcuate motion. Section B–B of FIG. 1 shown in FIG. 3 shows travel of platform 24 from first elevated position, indicated by dashed lines, to a second, floor level position.

FIGS. 1—3 illustrate the arrangement of rollers 26 about the framepost 28, 29. One roller, 26*a*–26*d* is located to each side of the post. As platform 24 travels vertically, rollers 26 rotate to permit rollers 26 to glide along posts 28, 29 where the outer surface 26*o* of rollers 26 contacts the perimeter of posts 28 and 29. Horizontal travel of platform 24 in the direction shown by arrow H+of the figure is resisted by reaction of rollers 26*a–b*, 26*g* (now shown) and 26*h* against the framepost. Similarly, horizontal travel of platform 24 in the direction indicated by arrow H− of the figures is resisted by the reaction of rollers 26*c–d* and 26*e–f* against the frameposts.

Figure 4A:
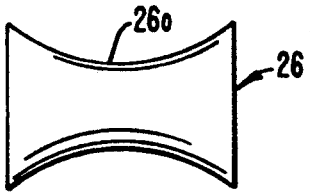
FIG. 4*a* and 4*b* shows a roller, as used in an embodiment of the present invention, in isolation.
Figure 4B:
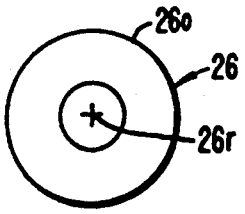

FIGS. 4A and 4B show a roller 26 in isolation. Rollers 26 contain an outer surface 26*o* which can be formed from a variety of materials including steel or hard durable plastic. Outer surface 26*o* is not a straight, but is a curved surface. The curvature is circular in nature and has a constant radius approximately equal to the radius of the frameposts. The length of outer surface 26 should be of sufficient length to prevent horizontal motion in a direction perpendicular to H+and H−. The outer surface 26*o* thus fits snugly against the outer surface of the frameposts. Outer surface 26*o* is rotatable about bearing 26*r*. Rotation of outer surface 26*o* about bearing 26*r* permits rollers 26 to travel along the length of frameposts 28 and 29.

Figure 5:
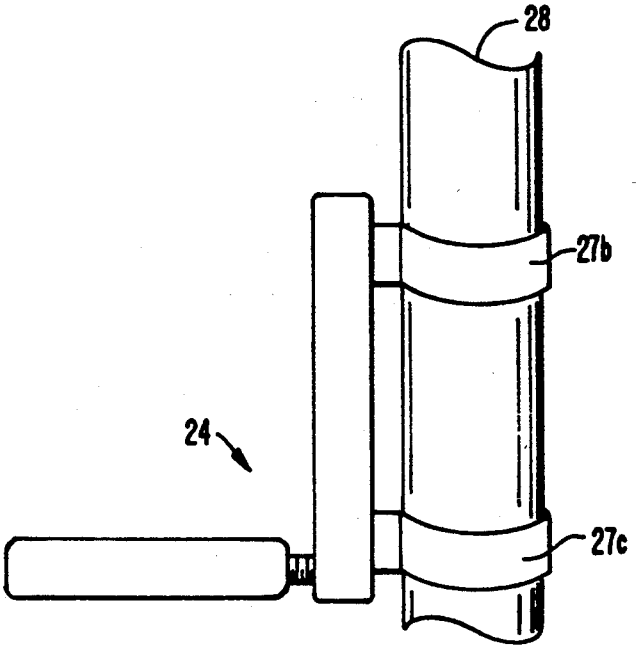
FIG. 5 shows a side view of a user assist platform secured to exercise apparatus frameposts with collars according to an embodiment of the present invention.
Figure 6:
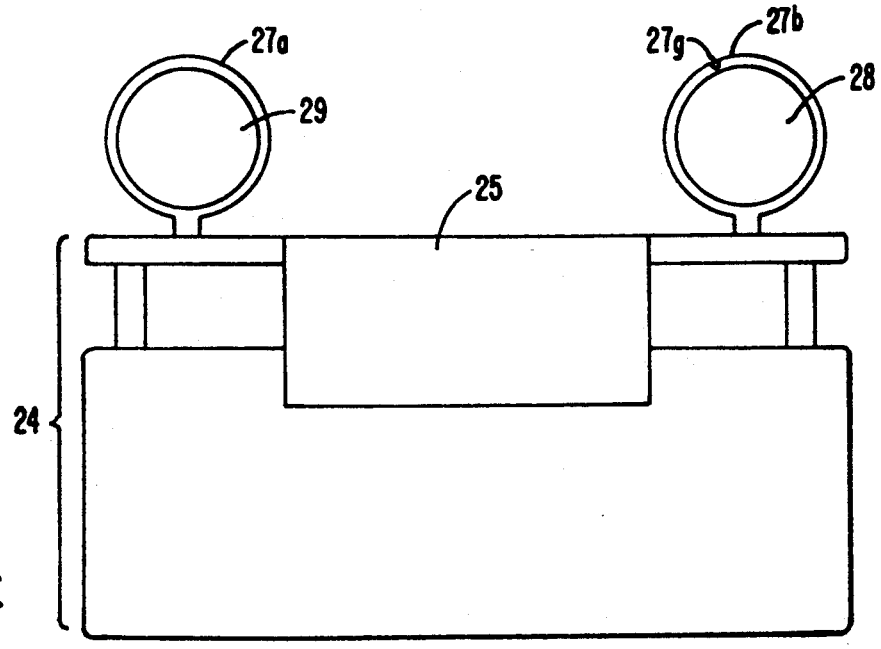
FIG. 6 shows a top view of a user assist platform secured to exercise apparatus frameposts according to an embodiment of the present invention.

Alternately, platform 24 may contain various types of guide members in lieu of rollers. The guide members used should provide sufficient support to platform 24 such that the platform does not tilt or sway and throw the user. FIGS. 5 and 6 show one such alternate guide member arrangement. In the figs. a collar 27 is secured at one end to platform 24 and wraps around vertical support posts 28 and 29. Collars 27 are ideally provided at four points of platform 24 to obtain maximum stability of the platform. Two collars can possibly be used to further reduce costs.

The collars, like the rollers, slide along the frameposts and permit platform 24 to travel in only a vertical direction. Horizontal motion of the platform is resisted by the inability of the collar to move horizontally with respect to the framepost and the reaction of the collar against the framepost when a horizontal force component is introduced to the system. Therefore, to ensure proper functioning of the collar structure, collars 27 should encompass frameposts 28 and 29 with sufficient clearance to permit vertical travel along the frameposts, but should have limited clearance to restrict horizontal freedom of movement. Collars may be fabricated to completely encircle the frameposts as is shown by 27*a* of FIG. 6. Collars 27 can also contain a small gap 27*g* as shown by 27*b* of the Figure. Gap 27*g* permits easy assembly of the apparatus since collars 27 need not be threaded onto the frameposts from one end but can be placed around the posts. Once around the posts gap 27*g* can be tightened to conform collars 27 to the desired diameter. Gap 27 also permits the diameter of collar 27 to be adjusted to account for thermal strain of collars and posts caused by climate changes.

Collars 27 can be fabricated from a variety of materials. One such material is Delrin TM, a plastic resin material manufactured by DuPont of Wilmington, Delaware. Delrin TM has the advantage of being a self lubricating material. Collars 27 can also be fabricated from steel, other metals and plastics. These materials, however, must be lubricated by maintenance personnel to reduce friction, wear and noise. Nevertheless, the collars are likely to be more noisy and less smooth than the rollers.

Motive force can be provided to platform 24 in a variety of fashions. For example, the motive force can be provided by: a weight stack; a vacuum cylinder; a pneumatic cylinder or an electric motor. By way of illustrating the principles of the present invention, in the embodiment of FIG. 1, L-shaped platform 24 is shown connected by a first pivot 100 to an actuating arm 30 which has a second pivot 32 located some distance from platform 24. One end of a pivoting rod 34, 35 attaches to actuating arm 30 at pivot point 32 and to a second pivot 35, 37 located on vertical supports 40 and 41 near the base 42 of the apparatus. A spring 45 is also attached to actuating arm 30 and secured to the device frame. Spring 45 provides a motive force to platform 24 which oscillates the platform vertically. The position of spring 45 relative to pivot 32 determines the amount and direction of the force applied to platform 24 by varying the moment about pivot 32. An electric motor 48, drives a jack screw 50 to position the spring along actuating rod 30. In FIG. 1, spring 45 is positioned aft of pivot 32. The force exerted by spring 45 on actuator rod 30 has therefore caused platform 24 to move from an elevated position, as shown by dashed lines in the figure, to a floor level position shown in solid lines.

As platform 24 moves vertically, pivoting rod 34 traverses an arc. The arc motion of rod 34 would normally pull actuating rod 30 away from frameposts 28 and 29 causing arcuate motion of platform 24. Any arcuate motion of the platform would corrupt the desired form of the dip or chin-up exercise and would also vary the magnitude of the vertical assist force provided to the user. Arcuate motion of the platform 24 is resisted, however, by the reaction of rollers 26 against frameposts 28, 29. The reaction of the rollers 26 against the frameposts allows the angle $\theta$ between the rods 30 and 34 to change as the platform rises. The motion of platform 24 thus remains vertical and undesirable arcuate motion of the platform is prevented.

The arc motion of rod 34 also causes slight changes in the length of spring 45 and also in the length of the moment arm as angle $\theta$ changes. On the vertically ascending portion of the arch, spring 45 contracts and the force exerted by spring 45 decreases. Conversely, on the descending portion of the arch traversed by rod 34, spring 45 lengthens with a corresponding increase in force. These force and moment arm variations if uncorrected, provide a non-constant assist force to the user.

To compensate for the spring force variations, electric motor 48 and jack screw 50 alter the attach position of spring 45 during motion of platform 24. As spring 45 shortens during upward vertical motion of platform 24, jack screw 50 drives the spring attach point from the initial point to a point further from pivot 32. The increased distance from pivot 32 compensates for the decrease in spring force and maintains a moment of constant magnitude about pivot 32. The mechanism of the present invention provides a substantially constant force to platform 24 and the degree of assistance provided to the user at the beginning of an exercise stroke is identical to the assistance provided at the end of the exercise stroke.

The operation of the apparatus of FIGS. 1-3 is best shown by way of example. FIG. 4 shows a user A stepping onto platform 24 to begin a chin-up exercise. A safety rail 55 prevents user A from falling backwards off platform 24. Once on platform 24, user A faces a control monitor 68 (not visible in FIG. 4). An enlarged view of the monitor 68 (not visible in FIG. 4). An enlarged view of the monitor 68 is drawn in FIG. 5. After turning on the apparatus with switch 89, the exerciser enters his/her weight using keypad 90. The amount of upward assistance force desired by the user can be entered as a percentage of the user's weight using bar graph 92. Panel 68 then displays the net weight to be lifted. The microprocessor, since it provides instructions regarding the exercise, can store indications of the elapsed exercise time and the number of repetitions of the exercise. As the exercise is performed, the number of repetitions and elapsed time will also be displayed, using the display unit.

Control panel 68 contains a microprocessor which controls electric motor 48. The microprocessor computes the weight to be lifted as the given percentage of the entered weight. The distance of spring 45 from pivot 32 necessary to impart this force to the platform is then calculated according to well known techniques. For example, the relationship $M_1 = F_1 \times d_1 = F_2 \times d_2$ where:

$M$ = moment about the pivot
$F_1$ = spring force
$F_2$ = % weight to be lifted by the platform
$d_1$ = distance from the spring attach point to the pivot
$d_2$ = distance from the center of the platform to the pivot can be used.

In response to the microprocessor, electric motor 48 drives jack screw 50 the required number of revolutions to position spring 45 in the desired position along actuating arm 30. The desired upward force is imparted to platform 24 once spring 45 is in this position. The sum of the vertical forces on platform 24 equals the user's weight plus the upward vertical force provided to the platform by the spring mechanism. So long as the percentage weight to be lifted by platform 24 is less than 100 %, the net vertical force will be down and platform 24 is less than 100 %, the net vertical force will be down and platform 24 will remain at floor level when user A is at rest. A large number of people cannot reach handles 22 when platform 24 is at floor level. To reach handles 22, user A must step on step 25 as shown in FIGS. 4 and 5. With both feet on step 25, user A can now easily grab onto handles 22. User A can now support enough of his own weight by clasping handles 22, that the net force on platform 24 is vertically upward and the platform begins to rise. Once platform 24 has travelled a sufficient distance, user A may step back down onto platform 24 as shown in FIG. 7 to begin the chin-up exercise.

Users of various sizes need only wait until platform 24 travels to the height preferred by that user for beginning the exercise. Exercisers of all sizes are accommodated by this procedure. No need to adjust the handles exists because platform 24 travels upward to meet the user. Handles 20 and 22 can therefore be fabricated as fixed elements to save costs over systems requiring adjustable handles. Alternatively, however, the upper body exercise apparatus may be fabricated with adjustable handles.

Figure 7:
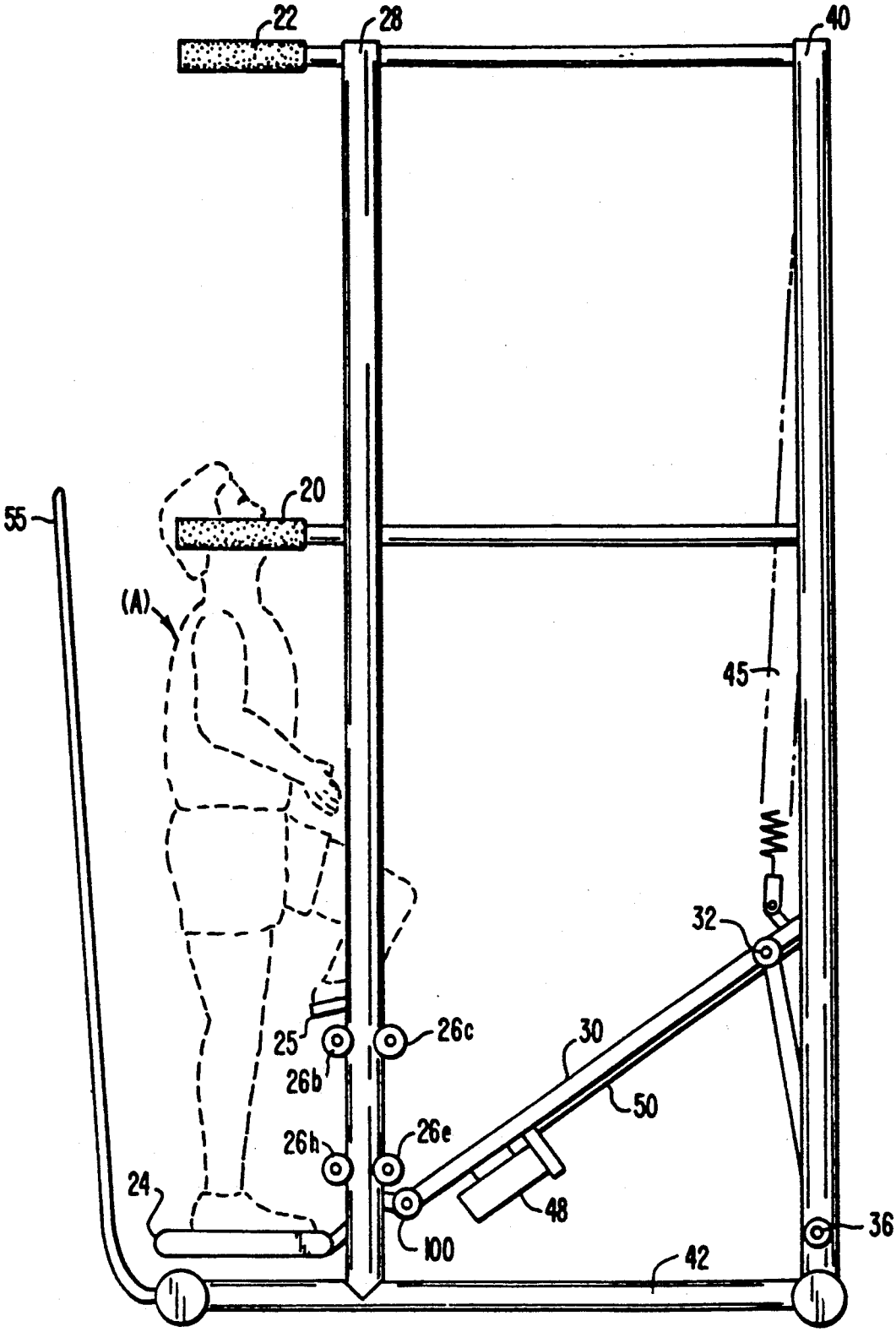
FIG. 7 shows an exerciser mounting an upper body exercise apparatus according to an embodiment of the present invention.

From the initial starting position shown in FIG. 7, Exerciser A then begins to pull himself up with the aid of the force supplied by the platform. As the exerciser moves in an upward vertical direction, L-shaped platform 24 travels upward along frame posts 28 and 29. Rollers 26 prevent arcuate motion of L-shaped platform 24 by preventing horizontal displacement of the platform relative to vertical frame posts 28 and 29. As the platform rises contact frame of the rollers 26, 27 with the posts 28 and 29 provides a force which causes member 34 to pivot about pivot 36 as the height of the platform increases. Motion of platform 24 during the upward exercise stroke is kept vertically by contact of rollers 26*a–b* and 26*g–h* with frame posts 28 and 29 which prevent horizontal travel of the platform.

Figure 8:
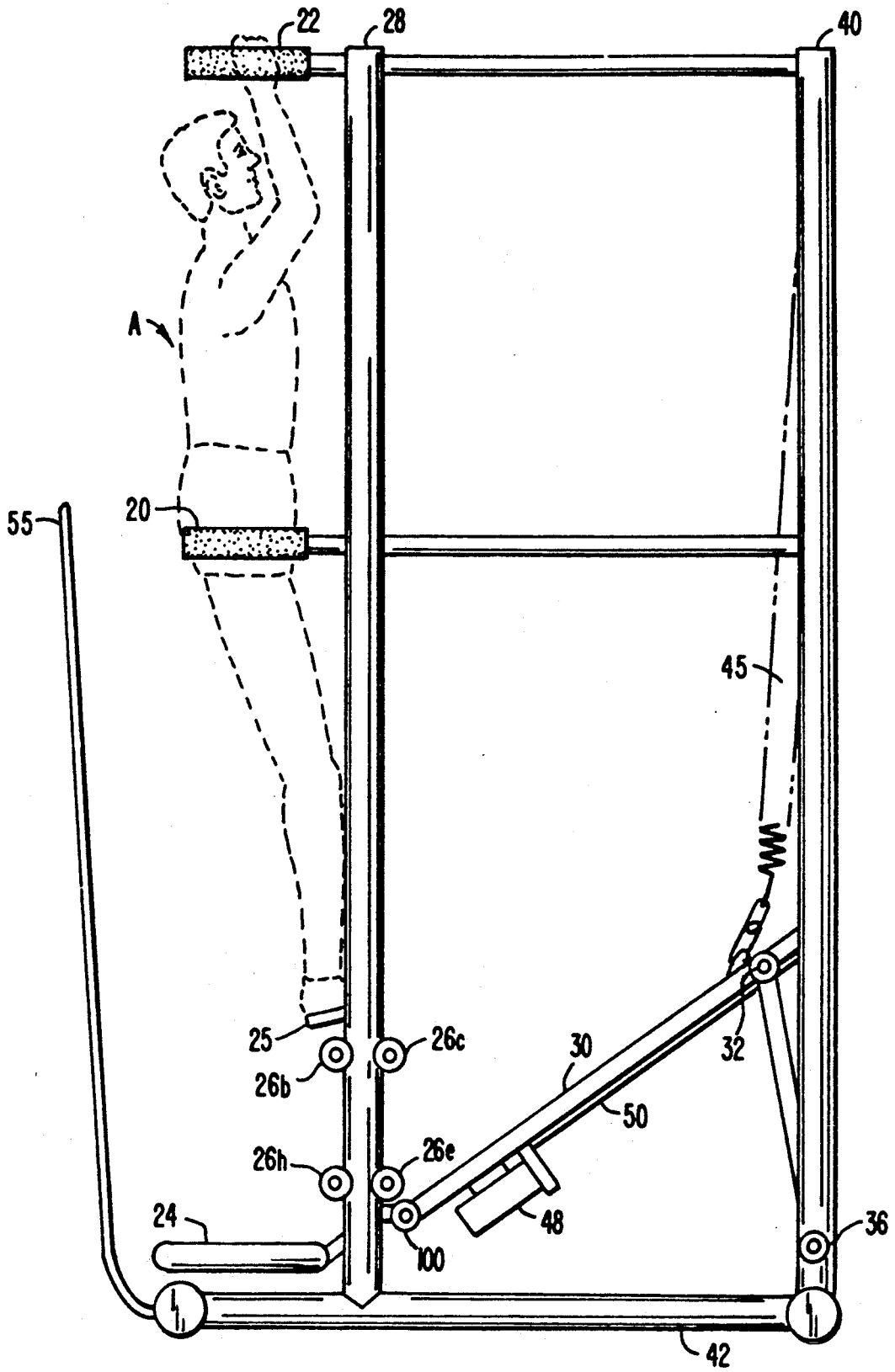
FIG. 8 shows an exerciser in position to grab chin-up exercise handles according to an embodiment of the present invention.
Figure 9:
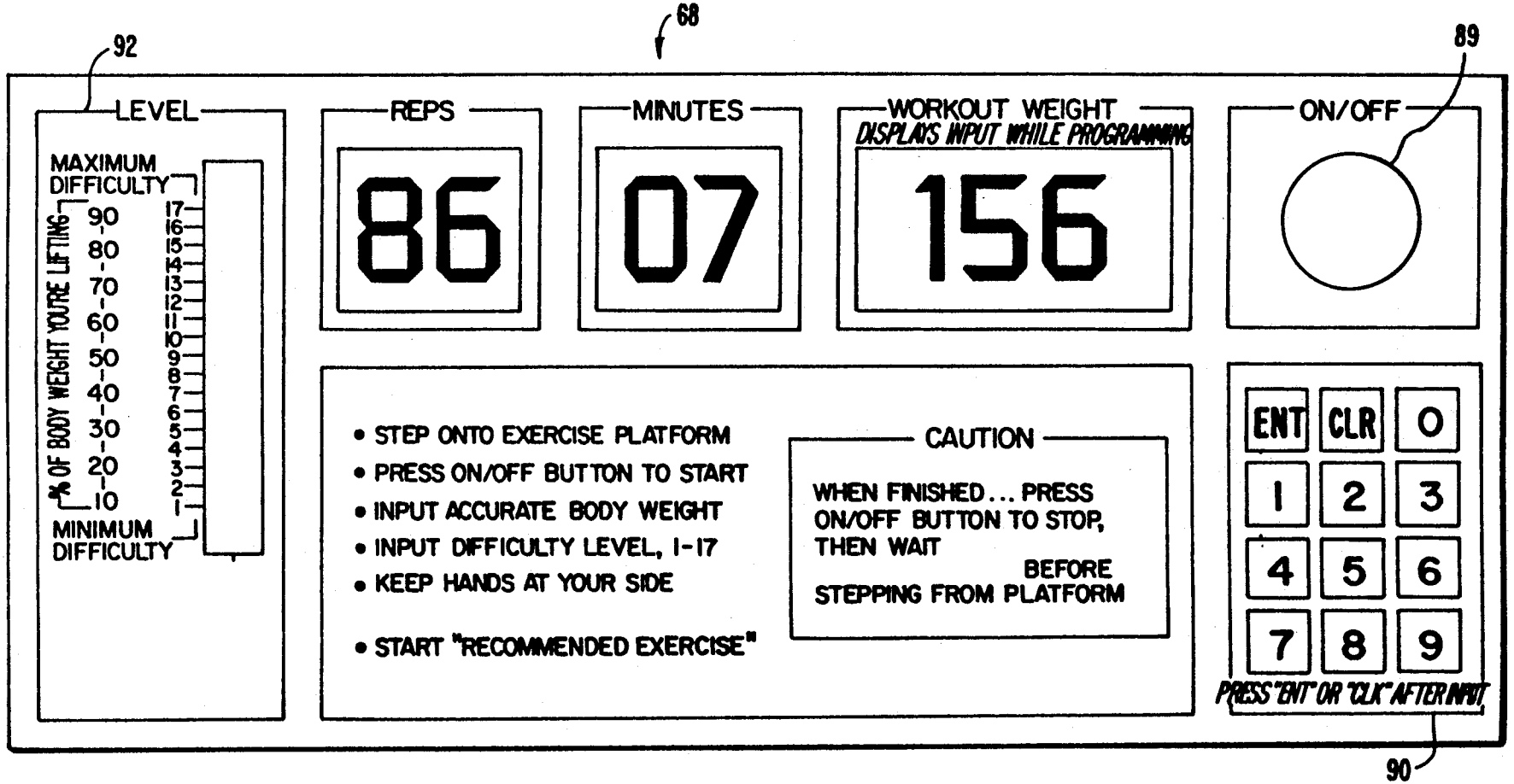
FIG. 9 shows a control console according to an embodiment of the present invention.
Figure 10:
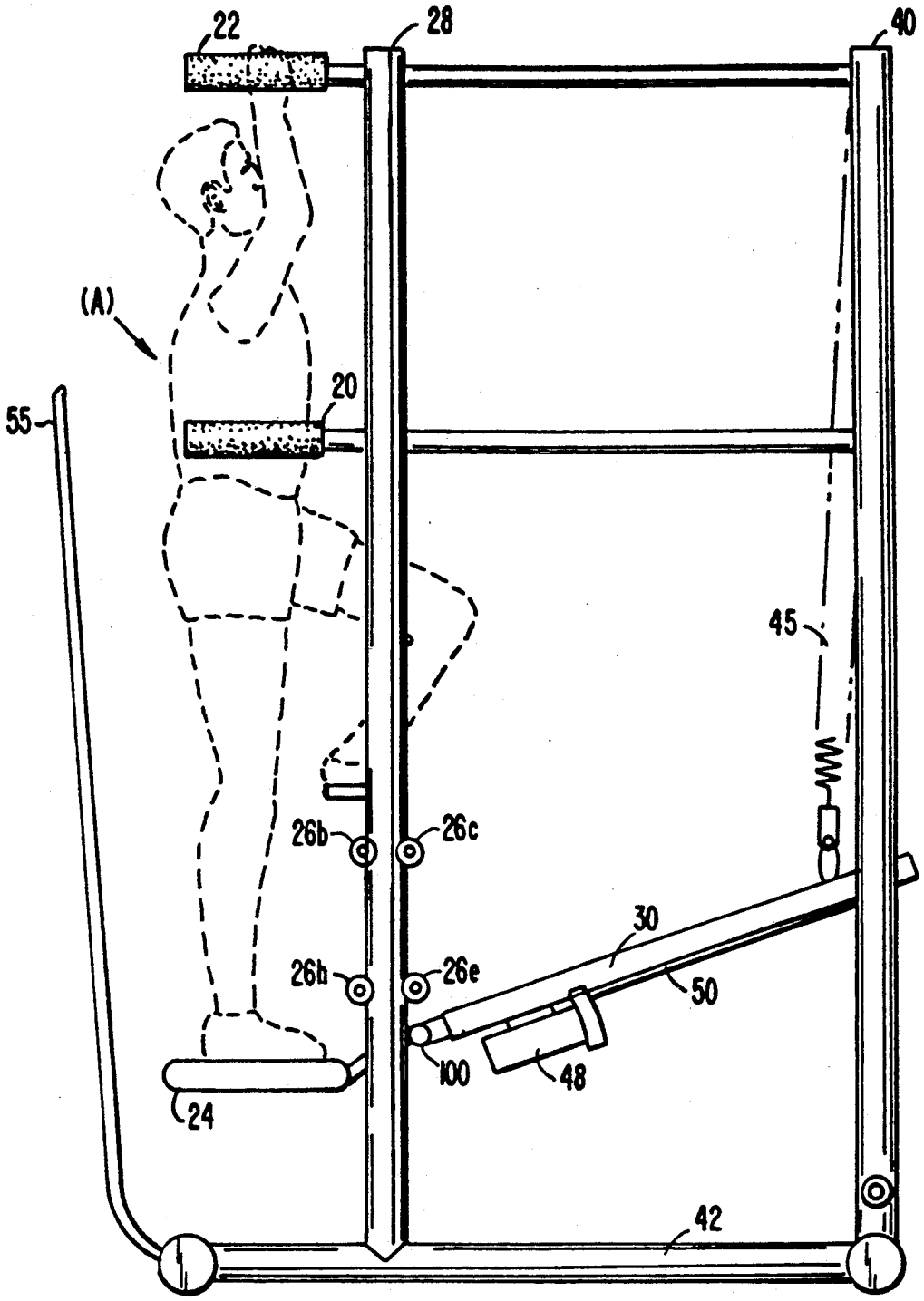
FIG. 10 shows an exerciser stepping into an initial starting position for a chin-up exercise according to an embodiment of the present invention.
Figure 11:
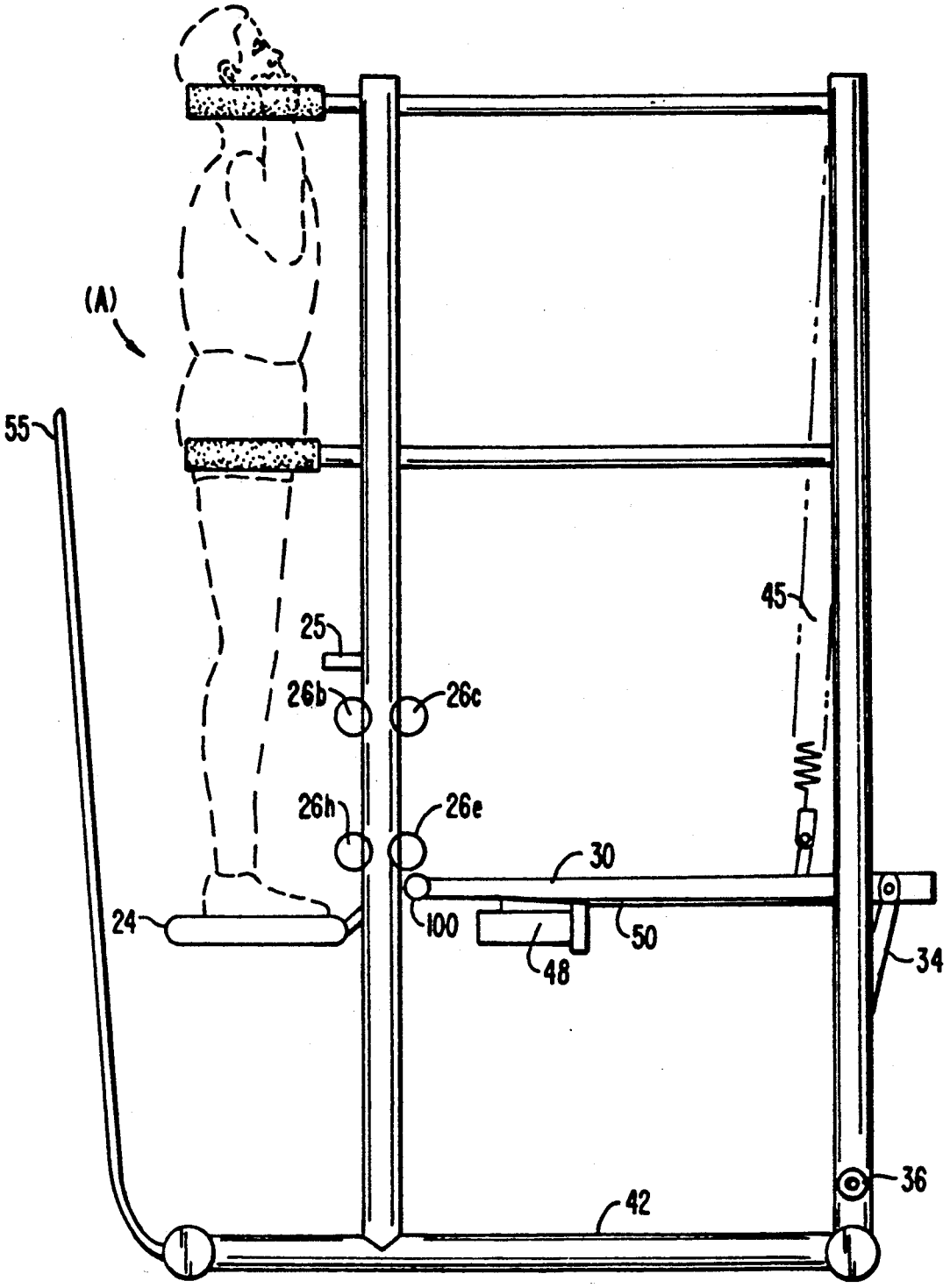
FIG. 11 shows an exerciser in a completed chin-up exercise according to an embodiment of the present invention.

Once at the top of the upward stroke of the exercise shown in FIG. 8, the exerciser stops exerting an upward force to pull himself up. The upward force exerted by the exerciser and the upward force imparted to the exerciser via platform 24 provide the net force necessary to complete upward stroke of the exercise. When the exerciser ceases to exert an upward force, the exerciser's own weight will be greater than and in an opposite direction from the upward force provided by platform 24. Platform 24 will slowly sink back to the initial starting position and repetitions of the exercise may be performed.

Upon completion of the desired number of exercises, User A can let go of handles 22 and remain at rest. Platform 24 will slowly sink back to the floor position since the user's weight exceeds the upward force provided by the platform. Motor 48 and jack screw 50 then position the attach point of spring 45 aft of pivot 32 so that platform 24 remains at floor level. In this configuration, User A can dismount the machine and subsequent users mount the machine.

As may be seen from the above description, the present invention provides a system for assisting the user in chin-up and dip exercises. The present invention achieves these ends without the need for a complicated system of hydraulic devices and levers. For this reason, the exercise apparatus of the present invention may be had at reduced costs and with improved convenience and reliability.

Variations and modifications will be readily apparent to those skilled in the art. For example, although the embodiment depicted shows fixed handles and although the apparatus is preferably capable of accommodating a range of exerciser heights without the need to adjust handles, nevertheless, adjustable handles can also be provided. Although the apparatus depicted in FIGS. 12–16 is intended for use with the exerciser in a kneeling position, other exerciser postures can also be provided such as standing, lying, sitting or squatting. A position such as a kneeling position provides the advantage that the overall height of the apparatus is smaller, compared to a device in which the exerciser is standing thus permits installation of the exercise apparatus in a room having standard ceiling heights as low as about eight feet.

Although the apparatus in FIGS. 12–16 depict a wheel-and-channel guidance device, other types of guidance mechanisms can be used such as a wheel-on-track system, a glider-in-channel system, a glider-on-track system, a linear linkage system, a screw-guidance system, and the like.

The exerciser can be supported by devices other than a pad or a platform such as a bar. A device can be provided in which the linear motion is non-vertical, such as being inclined. Although, in the embodiment depicted in FIGS. 12–16, the fore-to-aft distance 145 from the exerciser to the guidance system is relatively small, it is also possible to provide a longer distance from the exerciser to the guidance system, such as by mounting the guidance system near the aft portion of the frame. Providing a short distance from the exerciser to the guidance system provides a smaller overall torque 180 because of the smaller moment art, and thus provides less stress on the guidance/support mechanism while still maintaining the designed tracking.

In addition, the motive force to the platform can be provided from many sources and devices other than the particular mechanisms described herein. For example, the force source in the embodiment of FIGS. 12–16, in addition to a weight stack, can be an electric motor or a hydraulic lifter device. For these reasons, the invention should be construed in light of the claims.

What is claimed is:

1. Chin-up/dip exercise apparatus comprising:

an exerciser lifting support for supporting an exerciser, said exerciser having a weight;

a guidance system by which the exerciser lifting support is movably coupled to said frame, providing linear movement in a first direction;

at least a first handle coupled to said frame for grasping by the user during a chin-up/dip exercise;

a force source coupled to said exerciser support to supply a force to said exerciser support, said force having at least a first component in said first direction; and wherein said lifting support is horizontally spaced a first distance from said guidance system for using the weight of said exerciser, place on said lifting support to provide tracking loading on said guidance system.

2. Apparatus, as claimed in claim 1, wherein the weight of said exerciser provides a first torquing on said exerciser support.

3. Apparatus, as claimed in claim 1, wherein said force source is one of a weight stack, an electric motor and a hydraulic lifter.

4. Apparatus, as claimed in claim 3, wherein said line is one of a cable, a chain, a belt and a rope.

5. Apparatus, as claimed in claim 1, wherein said first direction is substantially vertical.

6. Apparatus, as claimed in claim 1, wherein said exerciser lifting support comprises one of a platform, a kneeling pad and a bar.

7. Apparatus, as claimed in claim 1, wherein said guidance system includes at least a first track and spaced apart first and second followers constrained to travel along said track.

8. Apparatus, as claimed in claim 7, wherein at least said first follower comprises a first wheel.

9. Apparatus, claimed in claim 1, wherein said guidance system comprises:

first and second channels first and second wheels positioned to travel in said first channel and connected by first and second axles to said exerciser lift portion;

third and fourth wheels positioned to travel in said second channel connected by third and fourth axles to said exerciser lifting support;

10. Apparatus, as claimed in claim 1, wherein said force source is coupled to said exerciser lifting support at an angle with respect to said first direction of less than about 20°.

11. Apparatus, as claimed in claim 1, wherein the apparatus has a height to permit use in a room having a ceiling height of about eight feet.

12. Apparatus, as claimed in claim 1, wherein said movement of said exerciser support is between a lowermost height and an uppermost height.

13. Apparatus, as claimed in claim 12, wherein said first handle is positioned between about 34 inches and about 40 inches above said uppermost height to accommodate chinning exercise.

14. Apparatus, as claimed in claim 12, wherein said first handle is positioned between about 71 inches and about 77 inches above said lowermost position to accommodate chinning exercise.

15. Apparatus, as claimed in claim 12, comprising at least one dip exercise handle, coupled to said frames, and positioned between about 39 inches and about 44 inches above said lowermost position.

16. Apparatus, as claimed in claim 1, further comprising at least a second handle coupled to said frame at a height lower than said first handle to accommodate chinning exercise using said first handle and dip exercise using said second handle.

17. Apparatus, as claimed in claim 1 wherein said apparatus is freestanding.

18. A chinning/dip exercise apparatus, comprising:

a frame;

a guidance system, coupled to said frame; and guidance system for supporting an exerciser, coupled to said supporting, such that a weight positioned on said means for supporting creates a first torque on said means for supporting with respect to said guidance system for providing tracking loading of said guidance system.

19. Apparatus, as claimed in claim 18, further comprising means for providing a force to said means for supporting to assist an exerciser in performing chinning or dip exercise.

20. Chin-up/dip exercise apparatus comprising:

a frame;

an exerciser support for supporting an exerciser;

a guidance system comprising at least one track and one wheel constrained to move along said track, said guidance system movably coupling said exerciser support to said frame and causing a force of said wheel to be applied against said track to avoid jamming;

a weight stack; and a line coupling said exerciser support to said weight stack to supply a force to said exerciser support for at least partially lifting both said exerciser support and said exerciser.

21. An upper body exercise apparatus to assist an exerciser comprising:

a frame having a base and a framepost;

a platform parallel to said base to support said exerciser;

at least a first handle coupled to and extending from said frame;

means for exerting a force, coupled to said platform, having a component in a first direction opposite a force of gravity, on said platform;

means for coupling said platform to said framepost such that said platform can move in a vertical direction relative to said framepost and cannot move in any horizontal direction relative to said framepost; and means for loading said means for coupling to enhance tracking.

22. Apparatus, as claimed in claim 1, wherein said force source is coupled to said exerciser support by a line.

* * * * *

UNITED STATES PATENT AND TRADEMARK OFFICE

CERTIFICATE OF CORRECTION

PATENT NO. : 5,312,313
DATED : May 17, 1994
INVENTOR(S) : Fred H. Holmes, et. al.

It is certified that error appears in the above-indentified patent and that said Letters Patent is hereby corrected as shown below:

Column 10, claim 1, line 49, after "comprising:" and before "an exerciser", insert --a frame;--.
Column 11, claim 4, line 4, delete "claim 3" and substitute therefor --claim 22--.
Column 11, claim 9, line 17, after "Apparatus" and before "claimed", insert --as--.
Column 12, claim 18, lines 7 through 9, delete "guidance system for supporting an exerciser, coupled to said supporting," and substitute therefor --means for supporting an exerciser, coupled to said guidance system for linear movement of said means for supporting,--

Signed and Sealed this

First Day of November, 1994

*Attest:*

*Attesting Officer*

Bruce Lehman

BRUCE LEHMAN

*Commissioner of Patents and Trademarks*